United States Patent [19]

Riordan

[11] Patent Number: 4,662,838

[45] Date of Patent: May 5, 1987

[54] FUEL BURNER CONTROL SYSTEM

[76] Inventor: William J. Riordan, 6 Mercury Dr., Shrewsbury, Mass. 01545

[21] Appl. No.: 695,797

[22] Filed: Jan. 28, 1985

[51] Int. Cl.[4] ..... F23N 5/12

[52] U.S. Cl. ..... 431/25; 431/69; 431/73; 431/78

[58] Field of Search ..... 431/25, 66, 69, 73, 431/78; 340/577, 579

[56] References Cited

U.S. PATENT DOCUMENTS 3,644,074 2/1972 Cade ..... 431/26
4,177,033 12/1979 Wallace ..... 431/78
4,298,335 11/1981 Riordan et al. ..... 431/25

FOREIGN PATENT DOCUMENTS 51-156536 6/1975 Japan .

*Primary Examiner*—Samuel Scott
*Assistant Examiner*—Allen J. Flanigan

[57] ABSTRACT

A control system including a valve for controlling the flow of fuel to a burner, a resistive heater element connected between first and second terminals and disposed for igniting fuel emanating from the burner, an isolation transformer comprising a heater secondary winding connected to the first and second terminals so as to provide heating current to the heater element, and an electrode spaced from the heater element in a zone occupied by flame emanating from the burner. Also included is a start-up circuit for opening the valve to provide fuel to the burner for ignition by the heater element and a flame sensing circuit comprising an ac source, coupling means connecting the ac source means between the electrode and one of the first and second terminals with the secondary winding connected to the first and second terminals, and a detector circuit for detecting the flow between the electrode and the heater element of current conducted by flame in the zone. Finally, a valve control circuit maintains the valve open in response to an output signal provided by the detector.

10 Claims, 2 Drawing Figures

FUEL BURNER CONTROL SYSTEM

BACKGROUND OF THE INVENTION

This invention relates generally to fuel burner control system and, more particularly, to a burner control system that utilizes a resistive heater element for igniting fuel emanating from a fuel burner.

The continuing interest in reduced energy consumption and increased safety has resulted in the development of safer and more fuel efficient burner control systems. Of particular note has been the extensive replacement of pilot burner systems with systems employing electronic ignitors that are energized only when main burner ignition is desired. Such electronic ignitor systems eliminate the fuel loss entailed by pilot burners during periods in which full burner operation is not required. Spark ignitors and resistive heater elements are two common mechanisms utilized to ignite fuel in electronic burner control systems. Although spark ignitors exhibit a number of desirable characteristics, resistive heating elements have certain inherent features that offer unique operational advantages. For example, a resistive heater element can establish a larger thermal mass than a conventional spark ignitor and, therefore, can provide more reliable ignition of less than optimum fuel and air mixtures. In addition, the positioning of a resistive heater ignitor with respect to a burner is less critical than that required for an analogous spark ignitor.

Disclosed in U.S. Pat. No. 4,298,335 is a burner control system in which a resistive heater element functions both as a fuel igniting mechanism and as a detection electrode for deriving flame rectified current. The dual functions simplify and reduce the cost of the control system. However, the heater element in the disclosed system can function only alternatively as an ignitor mechanism or a flame detection electrode. Consequently, the system can not provide simultaneous ignition and flame detection periods. That factor reduces the operational flexibility of the system and can result in nuisance lock-outs.

The object of this invention, therefore, is to provide an improved burner control system with a resistive element that functions both as an ignition mechanism and as a flame detection electrode.

SUMMARY OF THE INVENTION

The invention is a fuel burner control system including a valve for controlling the flow of fuel to a burner, a resistive heater element connected between first and second terminals and disposed for igniting fuel emanating from the burner, an isolation transformer comprising a heater secondary winding connected to the first and second terminals so as to provide heating current to the heater element and an electrode spaced from the heater element in a zone occupied by flame emanating from the burner. Also included is a start-up circuit for opening the valve to provide fuel to the burner for ignition by the heater element and a flame sensing circuit comprising an ac source, coupling means connecting the ac source between the electrode and one of the first and second terminals with the secondary winding connected to the first and second terminals, and a detector circuit for detecting the flow between the electrode and the heater element of current conducted by flame in the zone. Finally, a valve control circuit maintains the valve open in response to an output signal provided by the detector. The isolation transformer permits the simultaneous use of the resistive heater element as both an ignitor and flame detection electrode.

According to one feature of the invention the isolation transformer includes a control secondary winding connected to supply power to the start-up circuit, the flame sensing circuit, and the valve control circuit. This arrangement permits a single transformer to function efficiently as a supply for both the heater element and the control circuitry.

According to one feature of the invention, the heater timer and the detector circuit, respectively, simultaneously produce the heating signal and detect current flow. This feature facilitates the desired dual function of the heater element.

In a preferred embodiment of the invention, the start-up circuit comprises a heater timer for producing a heating cycle during a predetermined heating period and an ignition timer for producing an ignition signal during a given ignition period. During the heating period, the coupling circuit responds to the heating signal by producing current flow between the heater secondary winding and the heater element and during the ignition period the valve control circuit responds to the ignition signal by opening the valve. The start-up circuit also includes a delay means for delaying production of the ignition period for a finite period after initiation of the heating period. The finite period establishes the time required for the heater element to reach ignition temperature before the valve is opened to initiate the flow of gas. Preferably, the ignition period begins prior to termination of and continues during the heating period. This sequence insures the maintainance of the heater element at ignition temperature during the ignition period.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
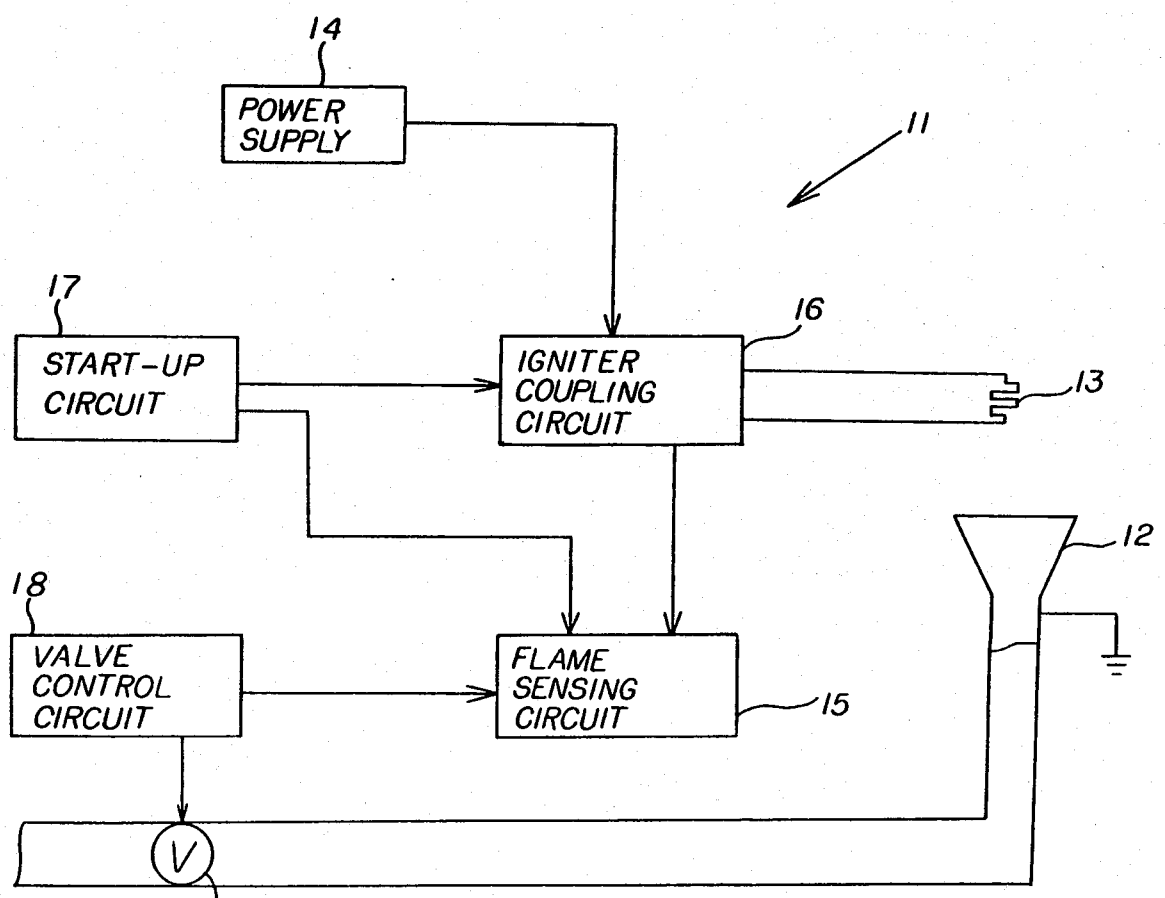
FIG. 1 is a schematic diagram illustrating functional aspects of the invention.

Schematically illustrated in FIG. 1 is a system 11 for controlling the operation of a fuel burner 12. Included in the system 11 is a resistive heating element 13 that can ignite fuel emanating from the burner 12 after being heated to ignition temperature by current supplied by a power supply 14. Also included in the system 11 is a flame sensing circuit 15 that detects and responds to flame rectified current passing between the heater element 13 and the grounded burner 12. The flame sensing circuit 15 is shown in greater detail in FIG. 2 and is descibed more fully below. An ignitor coupling circuit 16 interconnects the heater element 13 with both the power supply 14 and the flame sensing circuit 15. As also described more fully below, the system 11 prevents the flow of current between the power supply 14 and the flame sensing circuit 15 thereby permitting the simultaneous use of the heater element 3 as both a source of ignition and as an electrode for deriving flame rectified current.

The system 11 also includes a start-up circuit 17 and a valve control circuit 18. As described below, the start-up circuit 17 can be activated to produce a predetermined heating period during which a heating signal is applied to the coupling circuit 16 and a given ignition period during which an ignition signal is applied to the flame sensing circuit 15. In response to the heating signal, the coupling circuit induces the flow of current between the power supply 14 and the element 13 so as to produce heating thereof to ignition temperature. After a period required for the element 13 to reach ignition temperature, the ignition signal from the start-up circuit 17 causes the flame sensing circuit 15 to activate the valve control circuit 18 and induce opening of a valve 19 that supplies fuel to the burner 12. After ignition of fuel emanating from the burner 12, the flow of flame rectified current between the element 13 and the flame sensing circuit 15 occurs via the coupling circuit 16 which additionally prevents the loss of that current into the power supply 14. Thus, the heater element 13 serves the dual functions of an ignitor for igniting fuel at the burner 12 and an electrode for deriving flame rectified current for the flame sensing circuit 15.

Figure 2:
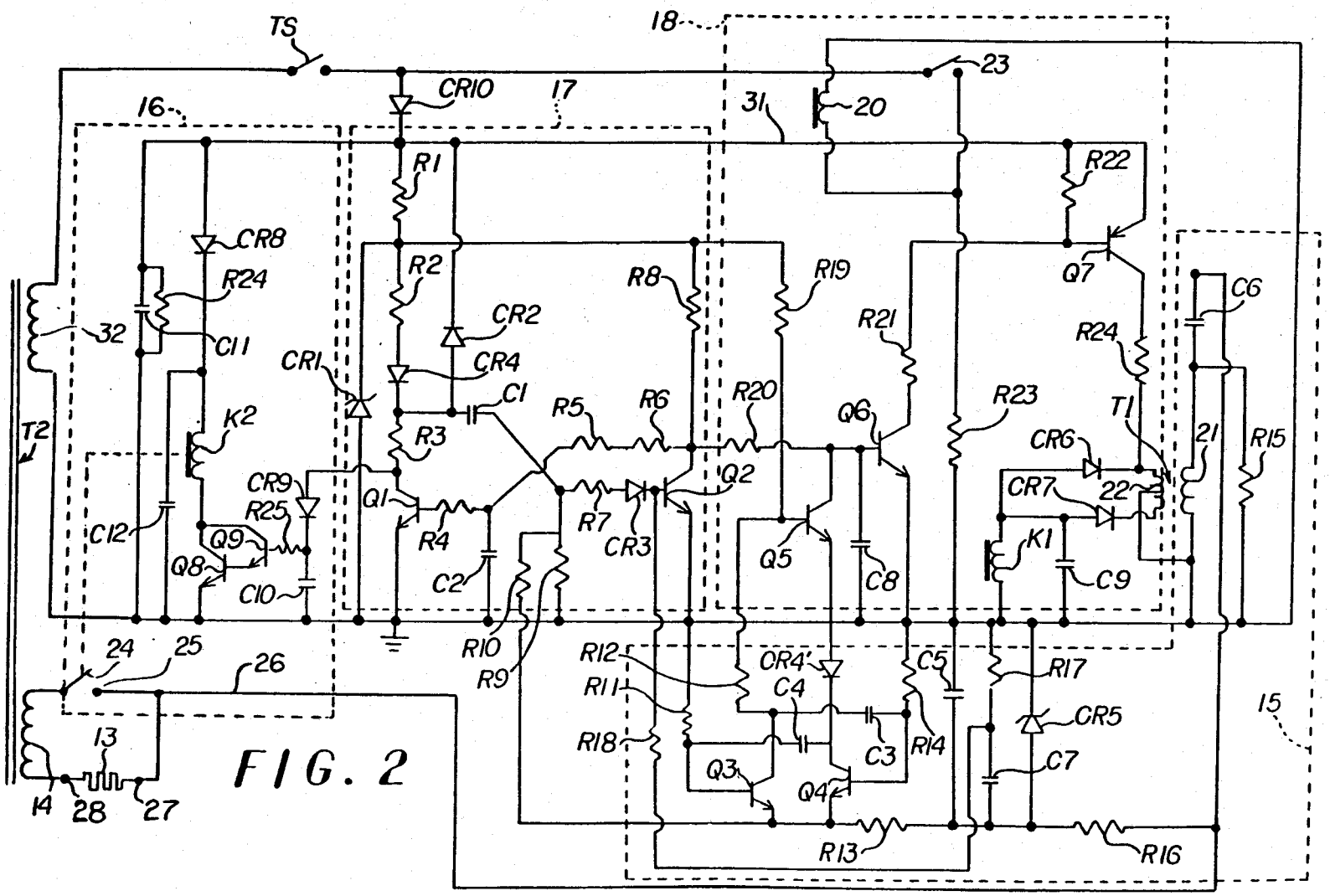
FIG. 2 is a schematic circuit diagram showing details of the circuits represented by the blocks in FIG. 1.

Referring now to FIG. 2 there is shown in greater detail the circuits depicted by blocks in FIG. 1. The start-up circuit 17 includes a basic multi-vibrator consisting of a pair of transistors Q1 and Q2 and associated resistors R1–R10, capacitors C1, C2, and diodes, CR1–CR4. Included in the flame sensing circuit 15 is a conventional multi-vibrator consisting of a pair of transistors Q3 and Q4 and associated resistors R11–R14, capacitors C3–C5 and diodes CR4 and CR5. Also included in the flame sensing circuit 15 is a detector network composed of a primary energy storing capacitor C6, a pair of resistors R15, R16 and a secondary winding 21 of a transformer T1. A reignition mechanism composed of a secondary storage capacitor C7 and resistors R17 and R18 also is included in the flame sensing circuit 15. The valve control circuit 18 includes three transistors Q5–Q7, the primary winding 22 of the transformer T1, a relay winding K1 and its associated contacts 23, a solenoid 20 associated with the valve 19, resistors R19–R22, a metal oxide varistor R23, capacitors C8 and C9 and a pair of diodes CR6 and CR7. Forming the coupling circuit 16 are a pair of transistors Q8, Q9, a relay winding K2 and its associated contacts 24, 25, resistors R24, R25, capacitors C10–C12, diodes CR8 and CR9 and a lead 26 connected to a terminal 27 of the heater element 13. Finally, a heater secondary winding of an isolation transformer T2 comprises the power supply 14 and is connected to terminals 27, 28 of the heater element 13 by the contacts 24, 25. A control secondary winding 32 of the isolation transformer T2 is connected to the circuits 15–18 by a thermostatic switch TS.

OPERATION OF THE INVENTION

In response to a call for heat indicated by closure of the thermostat TS, the start-up circuit 17 first activates the ignitor coupling circuit 16 with a heating signal to initiate energization of the heater element 13 and subsequently produces an ignition signal that is applied to the flame sensing circuit 15. In response to the ignition signal, the sensing circuit 15 activates the valve control circuit 18 which in turn opens the valve 19 to initiate gas flow to the burner 12. This operation occurs in the following manner. Current from the supply 32 flows through the thermostat TS, the diode CR10, the resistors R1, R2, the diode CR4 so as to charge the capacitor C1 through the resistor R7 and the diode CR3 into the base of the transistor Q2. This current flow turns on the transistor Q2. Conversely, a current attempt to flow through the resistors R8, R6, R5, and R4 to the base of the transistor Q1. The capacitor C2, however, acts as a delay preventing an immediate turn on of the transistor Q1. In addition, the turned on transistor Q2 serves as a short to ground for current flow through the resistors R5, R6. With the transistor Q1 turned off, a heating signal is supplied from its collector through the diode CR9 and the resistor R25 into the bases of the transistors Q9 and Q8. Accordingly the transistor Q8 is turned on to draw energizing current through the relay K2 and initiates a heating period. The activation of the relay K2 induces closure of contacts 24, 25, thereby connecting the heating element 13 to the heater secondary 14. The resultant current flow produces heating of the element 13 which can consist, for example, of a silicon carbide rod. After a period of, for example, 45 seconds, sufficient for the element 13 to reach fuel ignition temperature, the capacitor C1 is charged to a level that provides insufficient current flow to maintain conduction of the transistor Q2. That time period is determined by the time constant of the capacitor C1 and the resistors R1, R2 and R7. With the transistor Q2 switched off, its collector current is diverted through the resistors R6, R5, and R4 into the base of the transistor Q1 which switches on virtually tying the plus side of the capacitor C1 to ground. The capacitor C1 then provides an ignition signal that energizes the oscillator in the sensing circuit 15. Power for the oscillator is drawn from the capacitor C1 through the resistor R3 and the transistor Q1 to ground and from ground through the transistors Q3, Q4 and their collector and base components and finally back through the resistor R10. Power to amplify the output of the oscillator is taken from the collector of the transistor Q3 which is connected to the base of the transistor Q5.

The resistor 19 normally biases the transistor Q5 in a switched on condition which in turn maintains the transistors Q6 and Q7 in the off state. However, with the oscillator running, the current taken from the resistor R12 pulls current away from the resistor R19 so as to turn off the transistor Q5. Current is then allowed to flow through the resistor R20 and the base of the transistor Q6 which is switched on and draws current through the base of the transistor Q7 through the resistor R21. Thus, the transistor Q7 is switched on and off at the frequency of the oscillator and produces current through the resistor 24 that pulses the transformer T1. With the transistor Q7 on the relay K1 is powered by transformer action through the diode CR7. When the transistor Q7 is switched off, additional power is supplied to the relay K1 through flyback action of the collapsing transformer field through the diode CR6. The capacitor C9 functions as a filter for the relay K1. Energization of the relay K1 closes the contacts 23 to energize the solenoid 20 which in turn opens the valve 19 to initiate fuel flow to the burner 12. Fuel emanating from the burner 12 is then ignited by the heater element 13.

To insure that the heater element 13 will remain at ignition temperature during the ignition period, a means is provided for maintaining heating current flow for a period after the transistor Q1 has been switched on to initiate the ignition period. This means comprises the capacitor C10, the charge in which continues to supply base current for the transistor Q9 and thereby maintain energization of the relay K2. The capacitor C10 provides an additional heating period of, for example, ten seconds after initiation of the ignition period established by switching on of the transistor Q1. Discharge of the capacitor C10 terminates the heating period by de-energizing the relay K2 to disconnect the heater element 13 from the supply 14.

Discharge of the capacitor C1 terminates the ignition period by eliminating the application of an ignition signal to the sensing circuit 15. In the event that flame is not established at the burner 12 during the ignition period, the discharge of the capacitor C1 eliminates power for operating the oscillator in the sensing circuit 15. Consequently, the transistor Q5 is switched on to thereby switch off the transistors Q6 and Q7 and de-energize the relay K1. This in turn opens the contacts 23 and de-energizes the solenoid 20 to close the valve 19 and interrupt any additional fuel flow to the burner 12. In this locked out condition, a subsequent try for ignition can be accomplished only by reopening and closing of the thermostat TS.

Assuming however, that flame is established at the burner 12 during the ignition period, the sensing circuit 15 detects that flame and provides power to the oscillator that maintains a flow of fuel. As is well known, flame functions as a leaky diode which in this instance appears between the heater element 13 and the grounded burner 12. Thus, the ac voltage applied to the element 13 by the secondary winding 21 produces a rectified current flow tht charges the capacitor C6. The direction of that current flow is such that the transformer side of the capacitor C6 is positive and the side connected to the heater element 13 by the lead 26 is negative. The charge on the capacitor C6 is transferred through the resistor R16 to the capacitor C5 which acts to filter out any ac provided by the transformer T1. The capacitor C6 then supplies the oscillator with power through the resistor R13. Once the oscillator is started and flame continues, there exists a self-generating loop that insures a continued flow of fuel. However, if flame is subsequently lost, the flame rectified current is low and the capacitor C6 quickly discharges eliminating any source of power for the oscillator.

To minimize nuisance lookouts after losses of flame, the present invention provides a means for reignition in the sensing circuit 15. The reignition function is provided in the sensing circuit 15 by the capacitors C5, C7 and the resistor R17. When flame is lost, the very small capacitors C7 and C5 quickly discharge and the oscillator stops in a very short period of, for example, less than a second, to thereby close the valve 19 and interrupt fuel flow to the burner 12. However, the capacitor C5 discharges into the oscillator and a discharge path for the capacitor C7 exists through the resistor R18 to the base of the transistor Q2 to ground, and through the oscillator. The resultant current flow turns on the transistor Q2 initiating a complete new start-up sequence in the manner described above. In the event tht the subsequent start-up cycle fails to re-establish flame, system lockout will occur as above described.

Obviously, many modifications and variations of the present invention are possible in light of the above teachings. It is therefore to be understood that within the scope of the appended claims the invention can be practiced otherwise than as specifically described.

What is claimed is:

1. A fuel burner control system comprising:

valve means for controlling the flow of fuel to a burner;

a resistive heater element connected between first and second terminals and disposed for igniting fuel emanating from the burner;

isolation transformer means comprising a heater secondary winding connected to said first and second terminals and adapted to provide heating current to said heater element;

start-up means for opening said valve means to provide fuel to the burner for ignition by said heater element;

flame sensing circuit means comprising an ac source means and an electrode means spaced from said heater element in a zone occupied by flame emanating from the burner;

coupling means forming a connection between said heater element and said flame sensing circuit and permitting current from said ac source to flow between said heater element and said electrode;

detector circuit means for detecting the flow between said electrode means and said heater element of current rectified by flame in said zone, and producing in response thereto an output signal;

electrical switch means connected between said heater element and said heater secondary winding, said switch means being operable to alternately connect or disconnect said heater element from said heater secondary winding and thereby permit or prevent heating current flow therebetween without affecting said connection between said heater element and said flame sensing circuit means; and valve control circuit means for maintaining said valve means open in response to said output signal.

2. A system according to claim 1 wherein said transformer means comprises a control secondary winding connected to supply power to said start-up means, said flame sensing circuit means, and said valve control circuit means.

3. A system according to claim 2 wherein said start-up means comprises start-up circuit means comprising heater timer means for producing a heating signal during a predetermined heating period and an ignition timer means for producing an ignition signal during a given ignition period, said coupling circuit means responds to said heating signal by closing said electrical switch means to produce heating current flow between said heater secondary winding and said heater element and responds to an absence of said heating by opening said electrical switch means to terminate heating current flow therebetween; and said valve control circuit means responds to said ignition signal by opening said valve means.

4. A system according to claim 3 wherein said start-up circuit means comprises delay means for delaying the production of said ignition period for a finite period after initiation of said heating period.

5. A system according to claim 4 wherein said heater timer means and said detector circuit means are adapted, respectively, to permit simultaneous production of said heating signal and detection of said flame conducted current flow.

6. A system according to claim 1 wherein said start-up means comprises start-up circuit means comprising heater timer means for producing a heating signal during a predetermined heating period and an ignition timer means for producing an ignition signal during a given ignition period, said coupling circuit means responds to said heating signal by closing said electrical switch means to produce heating current flow between said heater secondary winding and said heater element and responds to an absence of said heating signal by opening said electrical switch means to terminate heating current flow therebetween, and said valve control circuit means responds to said ignition signal by opening said valve means.

7. A system according to claim 6 wherein said start-up circuit means comprises delay means for delaying the production of said ignition period for a finite period after initiation of said heating period.

8. A system according to claim 7 wherein said heater timer means and said detector circuit means are adapted, respectively, to permit simultaneous production of said heating signal and detection of said flame conducted current flow.

9. A system according to claim 1 wherein said electrode means comprises the burner, and said burner is electrically grounded.

10. A system according to claim 9 wherein said detector circuit means comprises capacitor means for storing energy carried by said flame conducted current.

* * * * *

UNITED STATES PATENT AND TRADEMARK OFFICE

CERTIFICATE OF CORRECTION

PATENT NO. : 4,662,838

DATED : May 5, 1987

INVENTOR(S) : William J. Riordan

It is certified that error appears in the above-identified patent and that said Letters Patent is hereby corrected as shown below:

On the title page Insert

--(73) Assignee: Kidde, Inc., Saddle Brook, N.J. --.

Signed and Sealed this

Twenty-fourth Day of November, 1987

*Attest:*

DONALD J. QUIGG

*Attesting Officer*

*Commissioner of Patents and Trademarks*